United States Patent [19]

Dugge

[11] 4,382,725

[45] May 10, 1983

[54] PNEUMATIC OUTLET VALVE

[75] Inventor: Richard H. Dugge, St. Louis, Mo.

[73] Assignee: ACF Industries, Incorporated, New York, N.Y.

[21] Appl. No.: 250,793

[22] Filed: Apr. 3, 1981

[51] Int. Cl.[3] ..... B61D 7/00

[52] U.S. Cl. ..... 406/131; 406/128; 222/547; 222/485; 251/299

[58] Field of Search ..... 406/131, 129, 127–133; 222/547, 557, 545, 485; 241/101.2, 274; 105/283; 137/242; 251/299

[56] References Cited

U.S. PATENT DOCUMENTS

| | | | |
|---|---|---|---|
| 3,194,420 | 7/1965 | Kemp et al. | 406/128 |
| 3,350,141 | 10/1967 | McGrath | 406/129 |
| 3,482,741 | 12/1969 | Fritz | 105/283 X |
| 3,701,460 | 10/1972 | Dugge et al. | 406/145 X |
| 3,778,114 | 12/1973 | Carney, Jr. et al. | 406/129 |

*Primary Examiner*—John J. Love
*Assistant Examiner*—L. E. Williams
*Attorney, Agent, or Firm*—Henry W. Cummings

[57] ABSTRACT

A pneumatic outlet is provided including a rotatable control valve having a body portion and a moment portion extending therefrom. The moment portion and the body portion each include edge portions which in closed position engage adjacent valve seats. The moment portion is provided with a pattern of openings for metering flow of lading into the discharge tube and is arranged to reduce or eliminate pellets from becoming trapped in the valve opening. Preferably the pattern includes alternate tapered projections and recesses. The tapered projections are arranged to guide pellets away from the valve opening. In addition, the projections preferably include sharp edges which will shear any pellets which are trapped in the recess, thus avoiding jamming the control valve. Preferably also the body portion edge includes a similar pattern.

20 Claims, 6 Drawing Figures

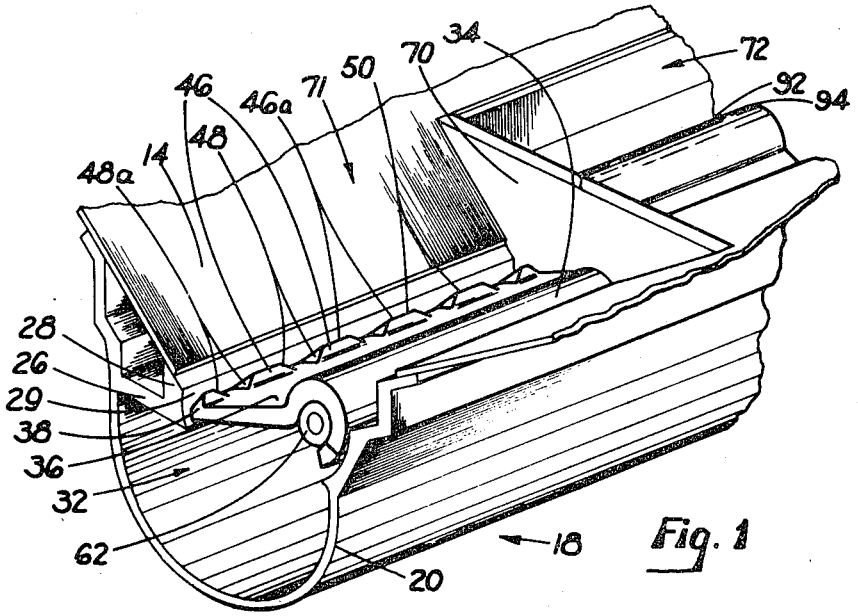
Fig. 1
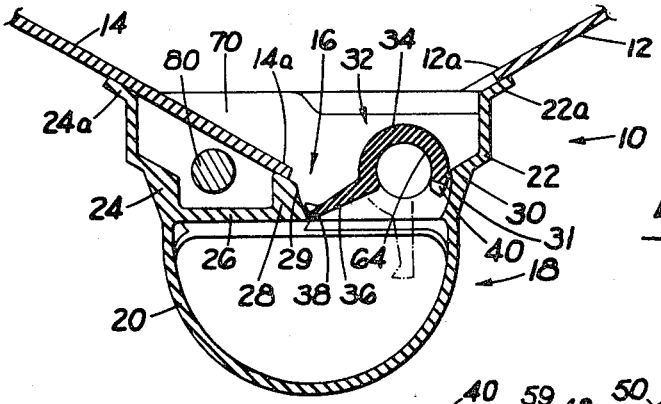
Fig. 2
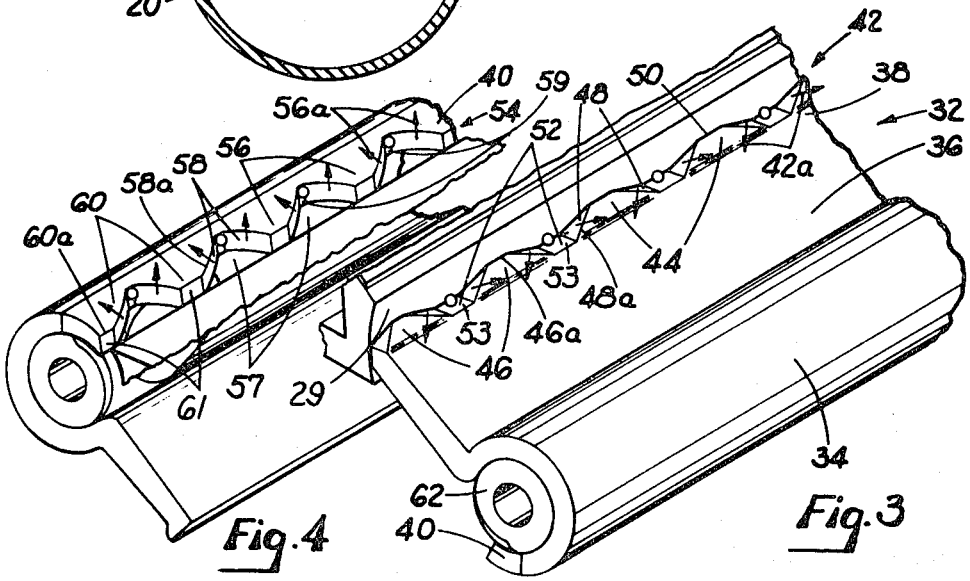
Fig. 4
Fig. 3

PNEUMATIC OUTLET VALVE

FIELD OF INVENTION

This invention relates to pneumatic outlets to unload lading from transportation vehicles and storage containers.

BACKGROUND OF THE INVENTION

U.S. Pat. No. 4,114,785 granted Dec. 11, 1978 discloses a pneumatic outlet including a control valve having a moment portion and a body portion. In closed position the control valve closes an opening between the lower inner edges of sloping outlet side walls. The moment portion and the body portion each have an edge portion which in closed position engages an adjacent seat portion located on a sloping outlet side wall.

However, with hard plastic pellets such as lucite, high density face cut polypropylene and face cut polystyrene, a problem has developed in operation of the outlet. When the valve is rotated from the open position to the closed position, hard pellets may become trapped between the moment portion edge and its valve seat. A similar problem, although less frequently, occurs when the body portion edge engages its adjacent seat. When pellets become trapped between the moment portion edge and and its seat, and/or the body portion edge with its seat, it sometimes becomes very difficult or impossible to completely close the control valve if required such as after sampling, suspended unloading or switching from one side to another.

SUMMARY OF THE INVENTION

The object of the invention is to provide a pneumatic outlet which avoids the tendency for particulate lading to become trapped between the moment portion edge and its seat, and/or the body portion edge and its seat, and thus render the control valve difficult to close.

In accordance with the present invention, the control valve moment portion is provided with a pattern of openings for metering flow of lading into the discharge tube which tends to reduce or eliminate pellets from becoming trapped in the valve opening. The pattern includes alternate tapered projections and recesses. The tapered projections are arranged to guide pellets away from the valve seat. The recesses allow metering of the lading into the discharge conduit. Preferably, the projections include sharp edges which will shear pellets which are trapped in the metering openings, thus avoiding jamming the control tube.

Preferably the body portion edge contains a similar pattern.

Preferably the moment portion edge includes a plurality of laterally spaced projections or lands defined by converging formed surfaces extending outwardly from the moment portion. Adjacent formed surfaces define slots or recesses between the projections. Preferably the projections or lands are of relatively short lateral extent. Preferably the converging surfaces are tapered with respect to the vertical in a direction such that the converging surfaces direct lading away from the moment portion valve seat. In addition, the juncture of the tapered surface with the upper surface of the moment portion provides a relatively sharp edge which is effective to shear pellets which have not been pushed away by the tapered surface. Preferably the body portion is provided with similar projections, slots and tapered surfaces to avoid trapping lading between the body portion edge and its valve seat.

IN THE DRAWINGS

FIG. 1 is a schematic perspective view of a pneumatic outlet including a control valve adopted to utilize the control valve patterns of the present invention.

FIG. 2 is a vertical sectional view of a pneumatic outlet having a control valve in which the edge portion patterns of the present invention may be utilized.

FIG. 3 is a detail view illustrating the pattern located on the moment portion edge.

FIG. 4 is a perspective view of the pattern utilized on the body portion edge.

DESCRIPTION OF PREFERRED EMBODIMENTS

Figure 5:
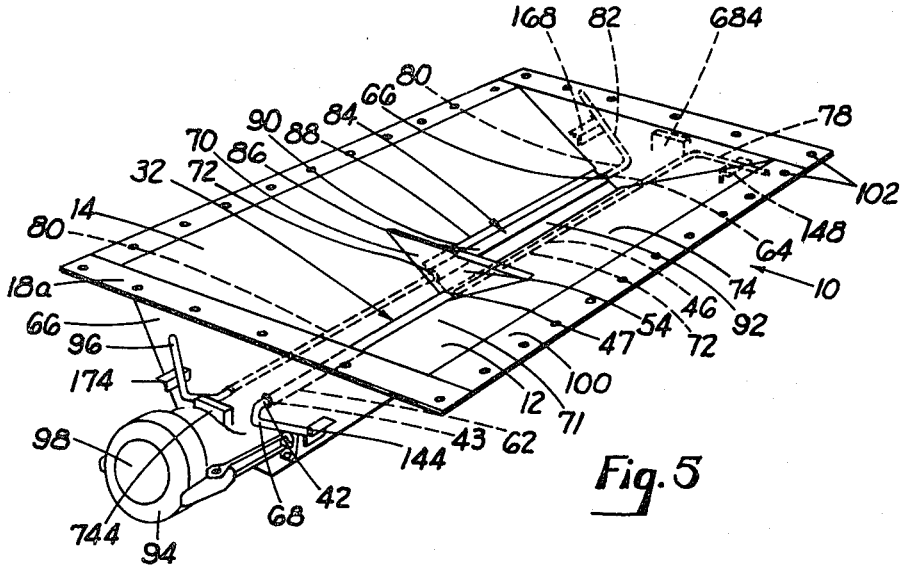
FIG. 5 is a schematic perspective view of a pneumatic outlet of the present invention including discharge chambers on either side of the outlet.

In the drawings a pneumatic outlet is indicated at 10. This outlet includes side walls 12 and 14 extending downwardly and having respective lower inner edges **12*a* and 14*a* which define a discharge opening 16. A discharge conduit indicated generally at 18 includes a lower discharging portion 20 in fluid communication with opening 16, and upwardly extending wall portions 22 and 24 which engage the respective outlet walls 12 and 14 at their inner edges 22*a* and 24*a*. In addition, the discharge conduit includes a generally horizontally extending plate portion 26 which has at its outer edge a valve seat 28. Valve seat 28 includes a curved valve seat surface 29. Discharge conduit portion 22 also includes a valve seat portion 30**.

A control valve indicated generally at 32 includes an arcuate body portion 34 and a moment portion 36 extending outwardly therefrom. Moment portion 36 includes an edge portion 38 which is located adjacent to and is adopted to engage in closed position valve seat 28. Body portion 34 includes an edge portion 40 which is located adjacent to and adopted to seat on valve seat 30.

In accordance with the present invention, the moment portion edge 38 is provided with a pattern indicated generally at 42 for preventing the trapping of lading between the moment portion edge 38 and its valve seat 28. This pattern includes a plurality of projections 44 extending outwardly and upwardly from the moment portion 36. The projections 44 include tapered surfaces 46 and 48 which tend to direct pellets away from the valve seat 28 as the moment portion is rotated into closed position adjacent the valve seat 28. The projections 44 further include land portions 50 which in closed position are located adjacent curved surface 29 or engage the same.

It will be seen that the surfaces 48 converge to define the land portions 50.

Spaced between the projections 44 are recesses 52. The recesses 52 allow metering of particulate lading through the discharge opening 16 into the discharge conduit 18.

The arrows **42*a* indicate the tendency of the projections to move pellets away from the seat 29. Thus pellets generally are only trapped along land portions 50 or along the base 53 of recesses 52** at the same time.

It also is to be noted that the tapered surfaces 46 and 48 terminate in sharp edges 46*a* and 48*a* which tend to shear any pellets which may remain on land portions 50 or in the recesses 52 as the moment portion is moved into closed position adjacent the valve seat 28. Shearing occurs most frequently on edges 46*a* and at the base 53 of recesses 52.

Also, it is evident that the extent to which the projections extend from the moment (FIG. 6) can be staggered as indicated at 44*a*, 44*b*, 44*c*, etc. Base portions 53 may also be staggered as indicated at 53*a*–53*d* so that pellets tend to be trapped along only one land 44 or base portion 53 at the same time.

Figure 6:
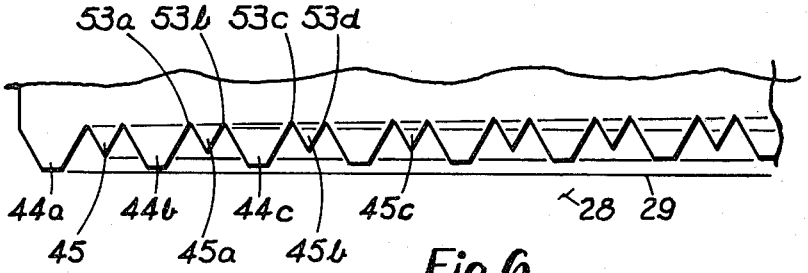
FIG. 6 is a schematic perspective view of another embodiment of the invention.

FIG. 6 also illustrates secondary projections 45 located in recesses 52. Secondary projections 45 are particularly helpful in metering a small amount of lading through discharge opening 16. Secondary projections 45 also can be staggered as indicated at 45*a*, 45*b*, 45*c*, etc.

As illustrated in FIG. 4, it is preferred that the body portion edge 40 include a similar pattern of projections and recesses indicated generally at 54 and including projections 56 having tapered surfaces 58 and 60 which direct pellets away from the moment portion valve seat 30 as the moment portion is rotated toward closed position as indicated by the arrows 56*a*. Furthermore, the tapered surfaces 58 and 60 preferably terminate in sharp edges 60*a* and 58*a* which tend to shear any pellets which remain on land portions 61 or remain within the recesses 57 located between the projections 56. Recesses 57 terminate in base portions 59. Recesses 57 are utilized to meter the flow of particulate lading from the discharge opening 31 into the discharge conduit 18. The land portions 61 and base portions 59 may be staggered in the same manner as illustrated in FIG. 6.

It is thus seen that the pattern 42 of projections 44 and recesses 52 including tapered surfaces 46 and 48 tend to reduce any pellets from being trapped between the moment portion edge 38 and the valve seat 28. Furthermore, it is seen that the pattern 54 of projections 56 including tapered surfaces 58 and 60 and recesses 57 tends to reduce the tendency of any pellets to be trapped between the moment portion edge 40 and its valve seat 30.

Another feature of the invention is that the recesses 52 and 57 allow small amounts of fine lading particles to be metered through the control valve 32 by opening it a small amount.

As is described in greater detail in U.S. Pat. No. 4,114,785 granted Sept. 19, 1978, the control valve 32 is rotated between open and closed positions by means of an operating shaft 62 extending through an opening 64 in the body portion 34. The shaft 62 extends outwardly through an end wall 66 and has attached thereto an operating handle 68. The operating shaft 62 extends through a divider wall 70 (shown in dotted lines in FIG. 5 for clarity) into an outlet discharge portion 72 which is a mirror image of the discharge portion 71. The shaft 62 passes below the outlet wall 74 and outwardly of the end wall 76 to a point on the outside of the outlet where an operating handle 78 is connected.

Similarly an operating shaft 80 includes an operating handle 82. The shaft 80 passes through the end wall 76 and is utilized to operate a control valve 84 in the discharge portion 72 having a body portion 86 and a moment portion 88. At least the moment portion edge 90 includes a pattern similar to the pattern 42 illustrated in FIG. 2. Preferably, also, the body portion includes an edge 92 which includes a pattern 94 similar to the pattern 54 illustrated in FIG. 4.

The operating shaft 80 then extends through the wall 70 and is located below the outlet wall 14 as illustrated in FIG. 1. The shaft 80 then passes through the end wall 66 and has a handle connected thereto 96 located outboard of the end wall 66. A cap 98 is provided for the discharge conduit 18 which extends outboard of the wall 66. A similar cap (not shown) is provided on the opposite end of the outlet.

It will be apparent that the control valves 32 and 84 can be operated from either end of the outlet by rotation of the handles 68, 96 from the near end illustrated in FIG. 5 and from the far end through operation of the handles 78 and 82. Stops 144, 174; 148, 168 and 684 and 744 are provided for locating the handles in respectively closed and open positions. A mounting flange 100 including fastener openings 102 is provided to mount the outlet on a suitable transportation vehicle such as a railway hopper car or a storage vessel for particulate lading.

What is claimed is:

1. A rotatable control valve comprising: a control valve body portion having a longitudinal axis and a moment portion extending outwardly from said body portion to establish a moment about said axis; said moment portion including a distal edge portion which in closed position engages an adjacent moment portion valve seat; said moment portion including at least one extension extending outwardly from said distal edge portion in a direction generally perpendicular to said moment portion; said extension including a pattern of projections and recesses for metering flow of lading into a discharge tube having a discharge opening located below said control valve and arranged to reduce or eliminate pellets from becoming trapped in the discharge opening; said projections arranged to guide pellets away from the discharge opening.

2. A control valve according to claim 1, wherein said projections are tapered.

3. A control valve according to claim 1, wherein at least some of said projections extend a different distance from the moment portion than other projections.

4. A control valve according to claim 3, wherein at least some of said projections are located at the base of at least some of said recesses.

5. A control valve according to claim 2, wherein said projections include sharp edges which tend to shear any pellets which are trapped as the moment portion assumes the closed position.

6. A control valve according to claim 5, wherein said body portion edge includes a similar body portion pattern.

7. A control valve according to claim 6, wherein at least some of said projections from the body portion are located at the base of some of said body portion recesses.

8. A control valve according to claim 6, wherein said body portion includes a pattern of projections and recesses for metering flow of lading into said discharge opening.

9. A pneumatic outlet comprising: tapered walls having lower inner ends which define a discharge opening; a discharge conduit located below said discharge opening; a rotatable control valve located within said discharge opening including a control valve body portion having a longitudinal axis and a moment portion extending outwardly from said body portion sufficiently from said axis to establish a moment about said axis; said moment portion including a distal edge portion which in closed position is located adjacent a moment portion valve seat; said moment portion including at least one extension extending outwardly from said distal edge portion in a direction generally perpendicular to said moment portion; said extension provided with a pattern of projections and recesses for metering flow of lading through said discharge opening and into said discharge conduit; and arranged to reduce or eliminate pellets from becoming trapped in the discharge opening; said projections arranged to guide pellets away from the discharge opening.

10. A pneumatic outlet according to claim 9, wherein said projections include sharp edges which tend to shear any pellets as the control valve assumes the closed position.

11. A pneumatic outlet according to claim 10, wherein said body portion edge includes a similar body portion pattern.

12. A pneumatic outlet according to claim 9, wherein said projections are tapered.

13. A pneumatic outlet according to claim 12, wherein at least some of said projections extend a different distance from the moment portion than other projections.

14. A pneumatic outlet according to claim 13, wherein at least some of said body portion projections are located at the base of at least some of said body portion recesses.

15. A pneumatic outlet according to claim 12, wherein the juncture of the tapered surface with the upper surface of the moment portion provides a sharp edge which tends to shear pellets which have not been pushed away by the tapered surface.

16. A pneumatic outlet according to claim 15, wherein said body portion is provided with body portion projections, body portion recesses and tapered surfaces to avoid trapping lading between the body portion edge and its valve seat.

17. A pneumatic outlet according to claim 16, wherein at least some of said body portion projections extend a distance from the body portion different from other body portion projections.

18. A pneumatic outlet according to claim 16, wherein at least some of said body portion projections extend a distance from the moment portion different from other projections.

19. A pneumatic outlet according to claim 18, wherein at least some of said body portion projections are located at the base of at least some body portion recesses.

20. A pneumatic outlet comprising: tapered walls having lower inner ends which define a discharge opening; a discharge conduit located below said discharge opening; a rotatable control valve located within said discharge opening including a control valve body portion having a longitudinal axis and a moment portion extending outwardly from said body portion sufficiently from said axis to establish a moment about said axis; said moment portion including a distal edge portion which in closed position is located adjacent a moment portion valve seat; said moment portion including at least one extension extending outwardly from said distal edge portion in a direction generally perpendicular to said moment portion; said extension provided with a pattern or projections and recesses for metering flow of lading through said discharge opening and into said discharge conduit and arranged to reduce or eliminate pellets from becoming trapped in the discharge opening; said pattern including a plurality of laterally spaced projections defined by converging formed surfaces extending outwardly from the moment portion; adjacent formed surfaces defining recesses between adjacent projections; said converging surfaces being tapered with respect to the vertical in a direction such that the converging surfaces direct lading away from said moment portion valve seat.

* * * * *